US009161627B2

(12) United States Patent
Donati

(10) Patent No.: US 9,161,627 B2
(45) Date of Patent: Oct. 20, 2015

(54) DEVICE FOR SYNCHRONIZING THE SEAT AND BACKREST OF A CHAIR

(75) Inventor: Armando Donati, Rodengo Saiano (IT)

(73) Assignee: DONATI S.P.A., Rodengo Saiano (BS) (IT)

( * ) Notice: Subject to any disclaimer, the term of this patent is extended or adjusted under 35 U.S.C. 154(b) by 0 days.

(21) Appl. No.: 13/580,028

(22) PCT Filed: Feb. 26, 2010

(86) PCT No.: PCT/IT2010/000082

§ 371 (c)(1),
(2), (4) Date: Aug. 20, 2012

(87) PCT Pub. No.: WO2011/104735

PCT Pub. Date: Sep. 1, 2011

(65) Prior Publication Data

US 2012/0313414 A1 Dec. 13, 2012

(51) Int. Cl.

| | |
|---|---|
| ***A47C 1/00*** | (2006.01) |
| ***A61G 15/00*** | (2006.01) |
| ***B60N 2/00*** | (2006.01) |
| ***B60N 2/02*** | (2006.01) |
| ***A47C 1/032*** | (2006.01) |

(52) U.S. Cl.
CPC ..... *A47C 1/03272* (2013.01); *A47C 1/03255* (2013.01)

(58) Field of Classification Search
CPC ..... A47C 1/03255; A47C 1/03272
USPC ..... 297/340, 300.5, 316, 301.4, 317, 320, 297/321
See application file for complete search history.

(56) References Cited

U.S. PATENT DOCUMENTS

| | | | | |
|---|---|---|---|---|
| 2,746,520 | A | 5/1956 | Ducrot | |
| 3,640,566 | A * | 2/1972 | Hodge | 297/68 |
| 4,387,876 | A * | 6/1983 | Nathan | 248/571 |
| 4,695,093 | A * | 9/1987 | Suhr et al. | 297/303.4 |
| 5,397,165 | A | 3/1995 | Grin et al. | |
| 5,421,640 | A * | 6/1995 | Bauer et al. | 297/372 |
| 5,577,802 | A * | 11/1996 | Cowan et al. | 297/301.2 |
| 6,709,057 | B2 * | 3/2004 | Sander et al. | 297/316 |
| 6,848,042 | B1 * | 1/2005 | Campbell et al. | 712/35 |
| 6,921,058 | B2 * | 7/2005 | Becker et al. | 248/419 |
| 7,147,287 | B2 * | 12/2006 | Kuivala | 297/344.14 |
| 8,615,828 | B2 * | 12/2013 | Schermel | 5/618 |
| 8,973,995 | B2 * | 3/2015 | Donati | 297/320 |
| 2004/0140703 | A1 | 7/2004 | Bock | |
| 2006/0163925 | A1 | 7/2006 | Bock | |

(Continued)

FOREIGN PATENT DOCUMENTS

| | | | |
|---|---|---|---|
| CN | 1810185 | A | 8/2006 |
| CN | 101161159 | A | 4/2008 |
| CN | 201091373 | Y | 7/2008 |
| CN | 101573060 | A | 11/2009 |

(Continued)

*Primary Examiner* — Chi Q Nguyen
(74) *Attorney, Agent, or Firm* — Lucas & Mercanti, LLP

(57) ABSTRACT

Device for synchronizing the tilt of the back and the seat of a chair, of the type comprising a back frame, a seat frame and a support constrained to, or coincident with, the base of the chair, as well as at least one first crank hinged to the support and a front portion of the seat frame, and at least one second crank hinged to the support and a rear portion of the seat frame, so that the afore said at least one first and one second crank constitute a four-bar linkage with the seat frame. Advantageously, the device provides that the back frame is integral with the afore said at least one first crank.

12 Claims, 3 Drawing Sheets

(56) References Cited

U.S. PATENT DOCUMENTS

| | | | | |
|---|---|---|---|---|
| 2007/0040432 | A1 | 2/2007 | Donati | |
| 2008/0084102 | A1 | 4/2008 | Link | |
| 2009/0195040 | A1 * | 8/2009 | Birkbeck | 297/317 |
| 2010/0084904 | A1 | 4/2010 | Erker | |

FOREIGN PATENT DOCUMENTS

| | | | |
|---|---|---|---|
| DE | 87 13 972 | U1 | 11/1987 |
| DE | 20 2005 011725 | U1 | 12/2006 |
| EP | 0 613 642 | A1 | 9/1994 |
| EP | 1 396 213 | A1 | 3/2004 |

* cited by examiner

DEVICE FOR SYNCHRONIZING THE SEAT AND BACKREST OF A CHAIR

CROSS-REFERENCE TO RELATED APPLICATION

This application is a 371 of PCT/IT2010/000082, filed Feb. 26, 2010, the contents of which are incorporated herein by reference.

FIELD OF THE INVENTION

The present invention relates to a device for synchronizing the tilt of the seat frame and of the back frame of a chair, or of any other seating means, relatively to the corresponding base, that is able to univocally correlate the mutual tilt of such frames and to determine such a tilt as a function of the user weight and of the type of rest the user is exercising onto the chair back.

BACKGROUND ART

It is known in the art to realize such synchronizing devices wherein a couple of first cranks, reciprocally parallel, and a couple of second cranks, reciprocally parallel too, connect the seat frame, respectively in its front and rear portion, with the chair base, thereby forming, with the same seat frame, a couple of four-bar linkages, each of them being disposed on a side of the chair. Such a synchronizing devices provide as well that the seat frame is cinematically constrained to such four-bar linkages, preferably by a leverage having a fulcrum on the base of the chair itself.

It has to be noticed that herein below reference will be made to such a synchronizing devices having one four-bar linkage only, composed of two cranks hinged in the chair base and, respectively, in the front and rear portion of the seat frame, both because it is theoretically possible the use of one four-bar linkage of such a type only, and because in such a way the description will be simplified.

For example, the French Patent FR 2045120, in the name of DUPART, teaches to realize such a synchronizing device for tilting the seat frame and the chair back frame by a four-bar linkage provided with only two cranks hinged between the base and the frame of the seat, and a lever with two arms, having a fulcrum on the same base, and wherein an arm is integral with the chair back frame and on the contrary the other arm is acting onto the rear portion of the seat frame, raising or pulling it down as a function of the angle and the tilting direction of the chair back.

Such a solution, although mechanically easy, however revealed not much comfortable for the user, because this latter is caused to exercise a considerable force onto the chair back for opposing to his/her own weight acting on the seat, due to the necessary reduction of the dimension of the afore said lever with two arms.

In addition, the DUPART Patent, because of the geometry of the described synchronizing device, does not provide, while varying the chair back tilt angle, the contemporaneous raising, or pulling down, of the front portion and the rear portion of the seat in such a way that this raising or pulling down of the front portion of the seat would be greater than the raising or pulling down of the rear portion of the seat.

The German Application DE 37 35 256, in the name of NIKOV, describes a synchronizing device of the tilt of the back and seat of a chair wherein the four-bar linkage comprises two cranks, one in the front and the other in the rear, that are hinged between the seat frame and the base of the chair, and wherein the seat frame is integral with the rear crank of such a four-bar linkage.

The front and rear cranks are tilted in different directions relatively to the vertical, that is if the front crank is tilted with an acute angle in the anticlockwise direction relatively to the vertical, then the rear crank is tilted with an acute angle in the clockwise direction relatively to the vertical, and/or vice versa.

Such a solution, not so much appreciated by all users, provided that when the tilt of the chair back changes, the front portion of the seat will raise and contemporaneously the rear portion of the seat will pull down, or vice versa.

In addition, the problem of the difficulties in tilting the chair back, because of the weight acting onto the seat and the lever arm not excessively long, would not seem to be solved by the NIKOV's device.

The International Patent Application WO 2008/067947, in the name of SATO OFFICE, refers to a device for synchronizing the tilt of the seat frame and the back frame of a chair comprising a four-bar linkage, wherein the two cranks are hinged to the chair base and, respectively, to the front and rear portions of the seat frame, and a lever with two arms having a fulcrum on the end extension of the rear crank. One of the two arms of such a lever is constrained, by means of a runner, to the front portion of the seat frame, whereas the other arm is integral with the back frame.

Also this SATO OFFICE's solution provides that the rotation of the chair back would cause the contemporaneous raising of the front portion of the seat and the pulling down of the rear portion of the same seat, with an effect not always appreciated by the user.

In addition, the use of a runner, made of a pin sliding into an extended eyelet, as a constrain between the afore said lever and the seat frame, will impose a high working and assembling precision of the SATO OFFICE's device.

It is therefore an object of the present invention to realize a device for synchronizing the tilt of the back and seat of a chair, or any other seating means, not presenting the drawbacks of the known prior art, and then resulting mechanically simple and comfortable for the user.

It is another object of the present invention to provide such a synchronizing device allowing the user, relatively to his/her own weight, to simply and effectively adjust the tilt of the chair back, and then of the seat, in such a way to obtain seat configurations allowing the user to obtain perfect postures.

SUMMARY OF THE INVENTION

These and other objects are obtained by the device for synchronizing the tilt of the back and seat of a chair, according to the first independent claim and the subsequent dependent claims.

The device for synchronizing the tilt of the back and the seat of a chair, according to the present invention, comprises a back frame, a seat frame and a support constrained to, or coincident (integral) with, the base of the chair, as well as at least one first—front—crank hinged to such a support and a front portion of the seat frame, and at least one second—rear—crank hinged to such a support and a rear portion of the seat frame, such first and second crank constituting a four-bar linkage with the seat frame. Advantageously, the device of the present invention provides that the back frame of the chair is integral with the afore said first (front) crank.

According to a preferred aspect of the present invention, the device comprises as well elastic means for returning the seat frame towards the support, preferably composed of at least one spring, for example a cylindrical helical spring, interposed between the pin of the afore said second (rear) crank on the seat frame and a front portion of the afore said chair support.

According to another preferred aspect of the present invention, although the afore said first (front) and second (rear) crank of the mentioned device are sloping in the same sense relatively to the vertical, the respectively subtended angles of such cranks relatively to the vertical are mutually different.

The extremely simple structure of such a device, as the Applicant could in practice verify, revealed to be able to allow the user a sensible and effective tilt regulation of the chair back and seat, to obtain extremely comfortable postures for the user itself.

In addition, the herein claimed geometry of the device, in a preferred embodiment thereof, may allow the contemporaneous raising or pulling down of the front portion and of the rear portion of the seat frame, as will be evident to a person skilled of the art, in such a way that such a raising—or pulling down—of the front portion of the seat frame, along the vertical, could appear quantitatively greater than the raising—or pulling down—of the corresponding rear portion of the seat frame.

BRIEF DESCRIPTION OF THE DRAWINGS

For purposes of illustrations, and not limitative, a preferred embodiment of the present invention will be described with reference to the accompanying drawings, in which.

DETAILED DESCRIPTION OF A PREFERRED EMBODIMENT OF THE PRESENT INVENTION

Figure 1:
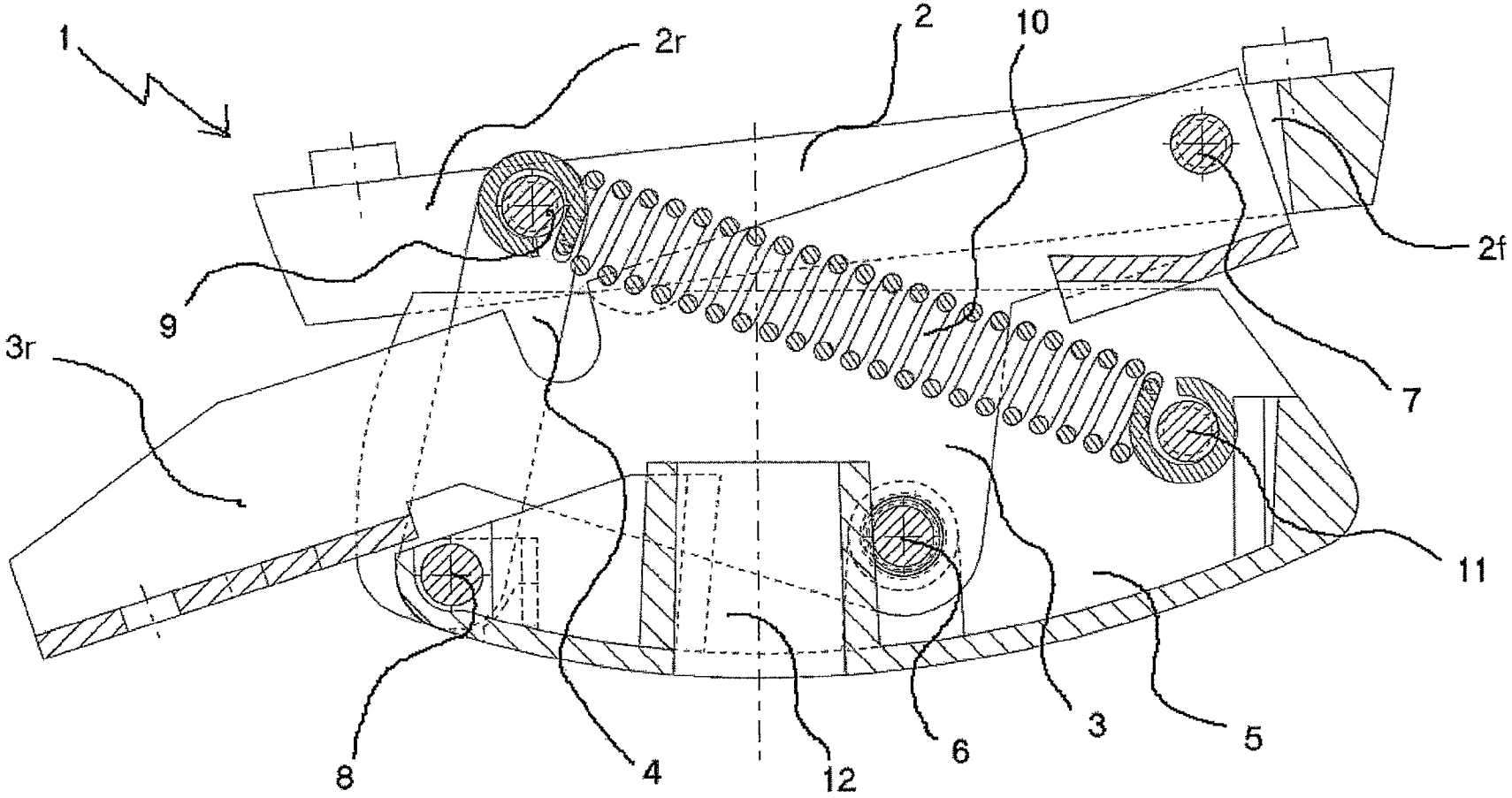
FIG. 1 is a partial side view of a device for synchronizing the tilt of the back and the seat of a chair, according to the present invention, depicted with the chair back disposed in its greatest tilting position.

Generally referring to the appended figures, the device 1 for synchronizing the tilt of the back and the seat of a chair herein shown, according to a preferred aspect of the present invention, comprises a seat frame 2, to which a chair seat is associated with in a known way, a back frame 13, to which the chair back is associated with, and a support 5 constrained to the base 14 of the chair, for example by clutching a pin, integral to the same base 14, into a sleeve 12 of which the support 5 could be provided with.

The synchronizing device 1 comprises as well at least one first front crank 3, and at least one second rear crank 4, which connect the seat frame 2 to the support 5, forming with such a seat frame 2 a four-bar linkage 2, 3, 4.

More in detail, in the particular embodiment herein illustrated, the front crank 3 is hinged at its ends, by the pins 6 and 7, respectively to the support 5 and to a front portion **2*f* of the seat frame 2, whereas the rear crank 4 is hinged, thanks to the pins 8 and 9, respectively to the support 5 and a to rear portion 2*r* of the same seat frame 2**.

Figure 2:
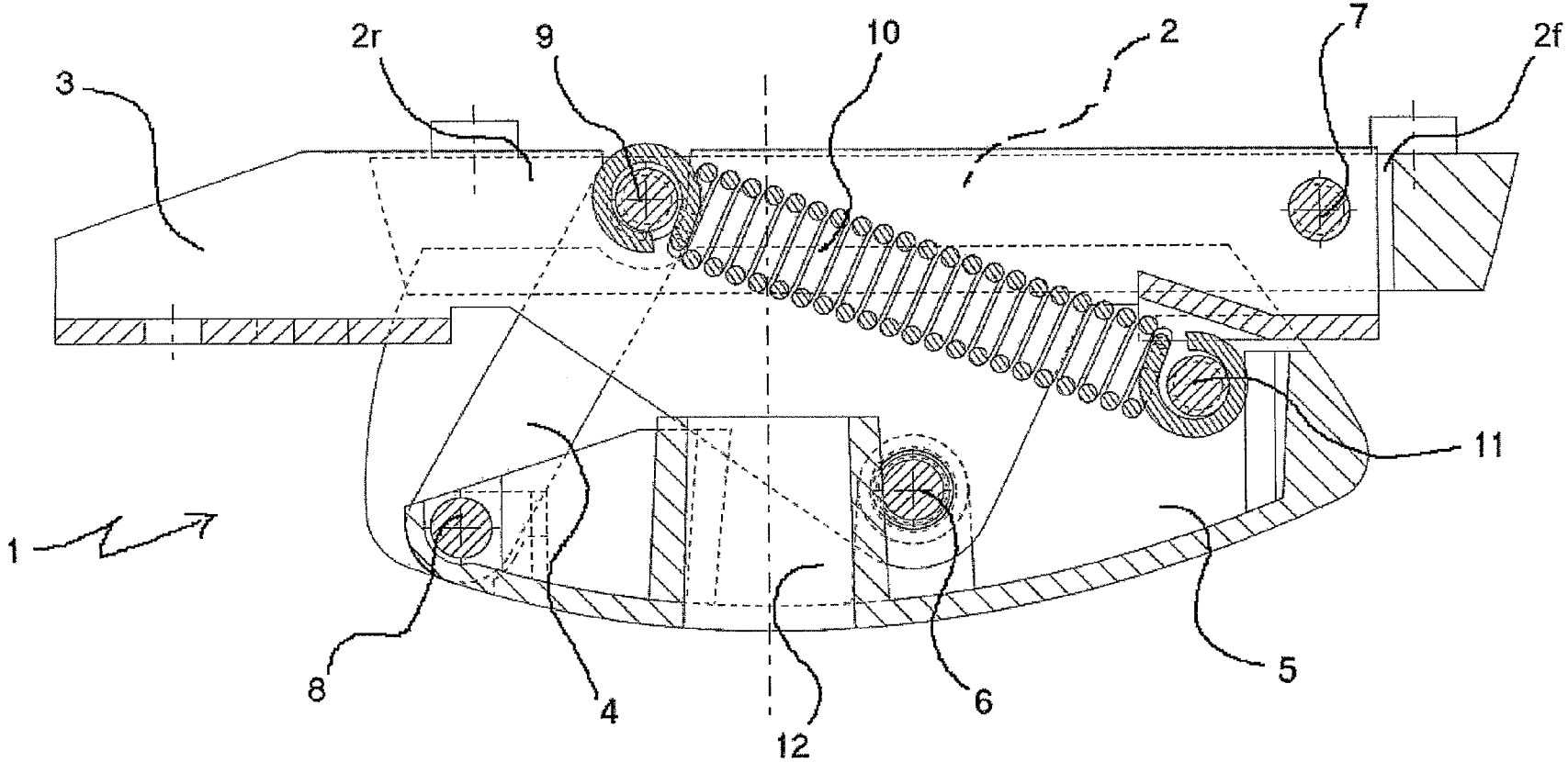
FIG. 2 is a partial side view of the device of FIG. 1, depicted with the chair back disposed in its lowest tilting position.
Figure 4:
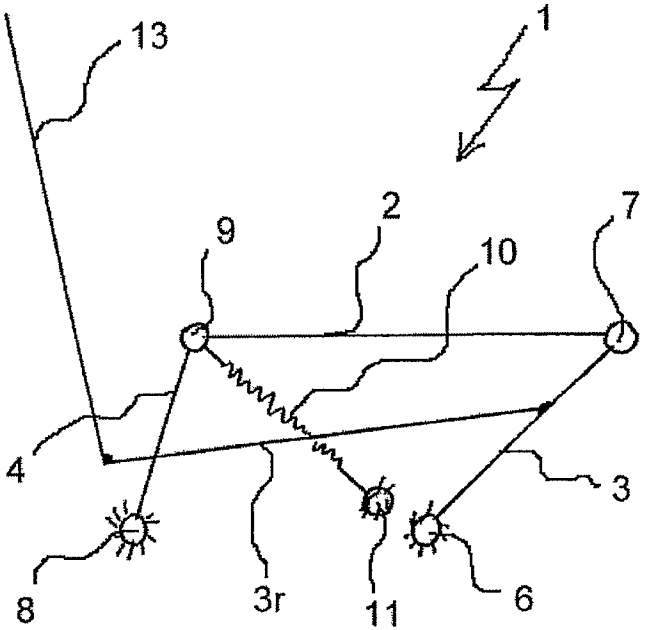
FIG. 4 is a partial mechanical scheme of the device of FIGS. 1 and 2.
Figure 3:
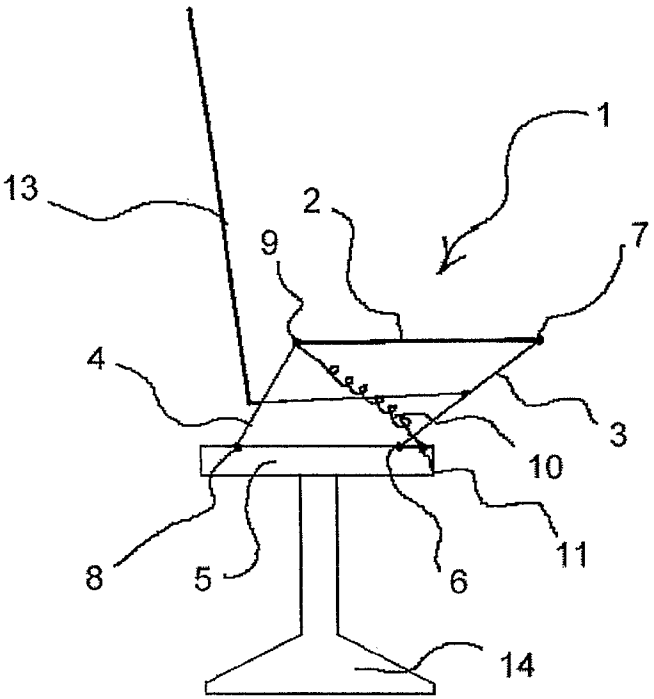
FIG. 3 is a scheme of the chair provided with a device depicted in FIG. 1 or 2.

Advantageously, as particularly visible in FIG. 3, the synchronizing device according to the present invention, herein shown, provides that the back frame 13 is integral with the front crank 3 of the four-bar linkage 2, 3, 4. Particularly, referring to FIGS. 1 and 2, the back frame 13 is made integral with a rear portion **3*r* of the front crank 3**.

In such a way, as could be noticed in practice, thanks to the longest lever arm the back frame 13 is provided with, and because the forces acting on the chair back are transmitted to the front crank 3 of the device, on which an usually lower load is acting when the user rests his/her weight on the seat, the regulation of the chair back tilt, and then of the seat, by the user is extremely effective and it causes the easy obtaining of chair configurations allowing the user comfortable postures, based on his/her weight.

It has to be noticed that, although it is herein depicted and described one four-bar linkage 2, 3, 4 only, according to a preferred embodiment of the present invention, the synchronizing device 1 herein represented may comprise two identical four-bar linkages, mutually parallel, placed at the two sides of the seat frame 2, so that the back frame 13 would seem, in this case, integral with the front cranks of the two parallel four-bar linkages of which such a device would be provided with.

Referring again to the four-bar linkage 2, 3, 4 afore described, according to a preferred aspect of the present invention, the rear portion **2*r* of the seat frame 2 and the support 5 are reciprocally connected to a spring 10 countering the displacement of the same rear portion 2*r* of the seat frame 2 moving away from the support 5, that is countering the displacement, rotationally anticlockwise in the figures, of the same seat frame 2 from its initial position; initial position wherein such a seat frame 2 is substantially horizontal and the back frame 13** is in its position of lowest tilt relatively to the vertical.

Advantageously, in the embodiment of the present invention herein shown, the spring 10 is a helical cylindrical spring, acting in traction, and constrained (hinged) in its ends, respectively to the support 5, by a pin 11, and to the rear portion **2*r* of the seat frame 2 thanks to a pin 9, that in its turn constrains the afore said rear crank 4 to such a rear portion 2*r* of the seat frame 2**.

It has to be observed that, for example but not exclusively, in case of two parallel four-bar linkages, the return springs 10 may be two or more, interposed between the seat frame 2 and the support 5. In addition, in other embodiments of the present invention, the spring 10 may be replaced with any other returning elastic means known in the art.

According to a preferred aspect of the present invention, the four-bar linkage 2, 3, 4, that could comprise retainers stopping the clockwise and/or anticlockwise rotation of one or the other crank 3, 4, is shaped in such a way that, upon the frame rotation of the chair back 13 towards greater tilt angles relatively to the vertical, and then upon the anticlockwise rotation of the front crank 3 about its pin 6 in the figures, the contemporaneous raising of the front portion **2*f* and the rear portion 2*r* of the seat frame 2 occurs, in such a way that the raising extent of the front portion 2*f*, along the vertical is greater than the extent of the contemporaneous raising of the rear portion 2*f***.

Of course, as will be evident for a person skilled in the art, the rotation in the opposite direction of the back frame 13, that is clockwise in figures, will lead to the contemporaneous pulling down of the rear **2*r* and front 2*f* portions of the seat frame 2, in such a way that the pulling down along the vertical is, at the same time, greater for the front portion 2*f* relatively to the rear portion 2*r* of the seat frame 2**.

Such a technical effect that, as will be evident to a person skilled in the art, is related, among other things, to the fact that the two cranks 3 and 4 are always sloping in the same sense relatively to the vertical, although with reciprocally different angles, that is they are disposed at the same part relatively to the vertical axis, will prevent the user to prove a unpleasant sinking sensation of the rear portion 2*r* of the seat frame 2, when the back frame 13 is tilted by crescent angles relatively to the same vertical:

In addition, in the embodiment herein shown, the non-excessively different length of the two cranks 3 and 4 (it has to be considered that the effective length of the crank 3 is provided by the distance between the pins 6 and 7) and the distance between the pins 9 and 7 and between the pins 6 and 8, and then the point that the angle subtended by the front crank 3 relatively to the horizontal (anticlockwise in figures) is acute, whereas the angle subtended by the rear crank 4 relatively to the horizontal (anticlockwise), will impart more regulating comfort to the device object of the present invention.

It has further to be noticed that, in the embodiments of the present invention herein not shown, the device 1 may further comprise one or more additional mechanisms for blocking the tilt of the chair back, in themselves known in the art, in addition to the before mentioned limit stops for limiting the rotation extent of one and/or the other crank 3, 4, in one or both rotation sense, such mechanisms preventing, when activated by the user, further rotations of the back frame 13 and the seat frame 2 and then further movements of the four-bar linkage 2, 3, 4.

The operation of the device herein shown is as follows.

In absence of a load weighting on the back frame 13, that is when the user is not seated or rested on the chair back, the spring 10, acting in traction, tends to maintain the seat frame 2 in its initial position, that is substantially horizontal. To such a substantially horizontal position of the seat frame 2 corresponds the position of lowest tilt relatively to the vertical of the back frame 13, thanks to the interlocking constrain between the same back frame 13 and the front crank 3.

When the user, once seated, rests on the chair back, he will exercise a force onto the back frame 13 that, although opposed by the spring 10, will cause the same back frame 13 to rotate (anticlockwise in figures) and, thanks to the solidarity constrain, the front crank 3 too, around a pin 6 constraining the same crank 3 to the support 5 of the base 14.

Such a rotation, thanks to the constrains between the various parts of the device 1 according to the present invention, is also reflected to the remaining part of the four-bar linkage 2, 3, 4, particularly causing the rear crank 4 to rotate, anticlockwise in figures, around its own pivot point 8 to the support 5, and then the rotation of the seat frame 2 around a swing center changing as times goes by.

As mentioned, the particular shape of the four-bar linkage 2, 3, 4 herein illustrated, according to a preferred aspect of the present invention, will cause the raising of both the rear portion 2*r* and the front portion 2*f* of the seat frame 2, during the afore described rotation, although the raising of the rear portion 2*r* is lower, along the vertical, than that along the front portion 2*f* of the seat frame 2.

The action countering the frame rotation of the chair back 13, exercised by the spring 10, allows the user to identify the better tilt of the same back frame 13 for his/her requirement.

It has to be observed that the particular geometry of the four-bar linkage 2, 3, 4 used for mutually constraining the support 5 (and hence the base 14 of the chair), the back frame 13 and the seat frame 2, together with the correct sizing of the spring 10, will allow the user to obtain an extremely accurate and effective tilt regulation of the chair back, also as a function of the distribution of his/her own weight.

Finally, when the user decides to reach a lower tilt of the chair back relatively to the vertical, by reducing the load exercised onto the back frame 13, or when the user decides to stand up off the chair, the action of the spring 10, tending to come back in its not deformed initial position (seen in FIG. 2) will cause the cranks 3, 4 to rotate clockwise in figures, respectively around the pins 6, 8, bringing back the seat frame 2 towards the initial position, and then the back frame 13.

The invention claimed is:

1. Device for synchronizing tilt of both a back and a seat of a chair, said chair comprising a back frame, a seat frame and a support constrained to, or coincident with, a base of said chair, a front rotatable crank hinged to said support and to a front portion of said seat frame thereby allowing rotational displacement between said support and said front portion of said seat frame, and a rear rotatable crank hinged to said support and to a rear portion of said seat frame thereby allowing rotational displacement between said support and said rear portion of said seat frame, said front and said rear crank constituting a four-bar linkage connecting said seat frame to said support, wherein said back frame is integral with said front rotatable crank, wherein said front rotatable crank and said rear rotatable crank allow tilting of said back frame and said seat frame for synchronizing the tilt of both the back and seat of the chair, and wherein, upon tilting of said back frame, said back frame and said front rotatable crank both rotate around a first pin constraining the front rotatable crank to said support.

2. Device according to claim 1, further comprising an elastic means positioned intermediate and connected to said seat frame and said support for returning said seat frame towards said support.

3. Device according to claim 2, wherein said returning elastic means includes at least one spring, interposed between said seat frame and said support, acting in traction.

4. Device according to claim 3, wherein said at least one spring is constrained to said support and to a point in which said rear rotatable crank is pivoted to said seat frame.

5. Device according to claim 1, wherein said front rotatable crank is sloping in the same direction relative to the vertical direction as said rear rotatable crank.

6. Device according to claim 1, wherein said front rotatable crank and said rear rotatable crank are sloping with different angles relative to the vertical direction.

7. Device according to claim 1, wherein said four-bar linkage is shaped for allowing the contemporaneous raising or pulling down of said front portion and of said rear portion of said seat frame.

8. Device according to claim 7, wherein the raising or pulling down of said front portion of said seat frame is, along the vertical direction, quantitatively greater than the raising or pulling down of said rear portion of said seat frame.

9. Device according to claim 1, wherein said front rotatable crank is hinged to said support by the first pin, and is hinged to said front portion of said seat frame, by a second pin.

10. Device according to claim 1, wherein said rear rotatable crank is hinged to said support by a third pin, and is hinged to said rear portion of said seat frame by a fourth pin.

11. Device according to claim 1, wherein said back frame is integral with a rear portion of the first rotatable crank.

12. Device according to claim 1, wherein under tilting of said back frame, said back frame and said front rotatable crank maintain a fixed reciprocal angle of inclination.

* * * * *